US005429354A

United States Patent [19]

Long et al.

[11] Patent Number: 5,429,354

[45] Date of Patent: Jul. 4, 1995

[54] CROWNLESS GOLF CLUB

[75] Inventors: James M. Long, South Hadley; John M. Krzynowek, Wilbraham; Steven J. Mahaffey, Hampden, all of Mass.

[73] Assignee: Lisco, Inc., Tampa, Fla.

[21] Appl. No.: 281,043

[22] Filed: Jul. 27, 1994

[51] Int. Cl.[6] ..... A63B 53/04

[52] U.S. Cl. ..... 273/78; 273/167 E; 273/169; 273/167 H; 273/173

[58] Field of Search ..... 273/167 R, 77 R, 167 E, 273/162 E, 169, 167 F, 78, 193 R, 194 R, DIG. 23, 162 R, 194 A, 167 D; D21/214, 215; 273/167 H, 173, 167 J

[56] References Cited

U.S. PATENT DOCUMENTS

| | | | |
|---|---|---|---|
| D. 202,715 | 11/1965 | Solheim . | |
| D. 208,058 | 7/1967 | Johnston . | |
| D. 268,357 | 3/1983 | Mader . | |
| 708,575 | 9/1902 | Mules | 273/78 |
| 777,400 | 12/1904 | Clark | 273/78 |
| 3,880,430 | 4/1975 | McCabe | 273/78 |
| 4,431,192 | 2/1984 | Stuff, Jr. . | |
| 4,679,792 | 7/1987 | Straza | 273/78 |
| 4,754,969 | 7/1988 | Kobayashi | 273/78 |
| 4,900,029 | 2/1990 | Sinclair | 273/167 E |
| 5,060,949 | 10/1991 | Brill . | |
| 5,174,573 | 12/1992 | Desbiolles et al. . | |
| 5,205,560 | 4/1993 | Hoshi | 273/78 |
| 5,255,913 | 10/1993 | Tsuchida | 273/78 |
| 5,310,185 | 5/1994 | Viollaz | 273/78 |

OTHER PUBLICATIONS

First Group Auctioneers & Appraisers, "A Golf Memorabilia & Collectibles Auction," Saturday, May 21, 1994 at 12:00 noon; cover and pertinent pages for Item 51.

*Primary Examiner*—Sebastiano Passaniti
*Attorney, Agent, or Firm*—Donald R. Bahr; John E. Benoit

[57] ABSTRACT

A golf club head comprising a striking face section, a sole, and a flange extending about the periphery of the sole. The flange decreases in height from the upper edge of the striking face section to the back edge of the sole. A composition insert is secured within the front of the striking face section. This structure provides a crownless club head.

8 Claims, 1 Drawing Sheet

CROWNLESS GOLF CLUB

This invention relates generally to golf clubs, and more specifically to a wood type club which has no crown.

BACKGROUND OF THE INVENTION

Wood type clubs normally used comprise a striking face, a toe, a heel, a sole, and a crown. In the case of metal woods, they are normally hollow and may have additional structure in the interior and also may be filled with a composition or the like.

It is desirable in wood type clubs to attain the maximum performance and yet avoid having clubs which weigh too much and, thus, have a heavy feeling when being used.

One type of club which has been produced relates to an aluminum cast club which has basically no crown and has a scored front face. This club has a standard hosel and the shaft is then mated with the hosel and secured thereto.

The present invention provides an improvement on such a basic crownless club through proper weight distribution, hosel length, face thickness, and the use of a composition insert in the face of the club.

SUMMARY OF THE INVENTION

This invention provides a golf club head comprising a striking face section, a sole, and a flange extending about the periphery of the sole. The flange decreases in height from the upper edge of the striking face section to the back edge of the sole. A composition insert is secured within the front of the striking face section with the structure resulting in a crownless club head.

DETAILED DESCRIPTION OF THE PREFERRED EMBODIMENT

Figure 1:
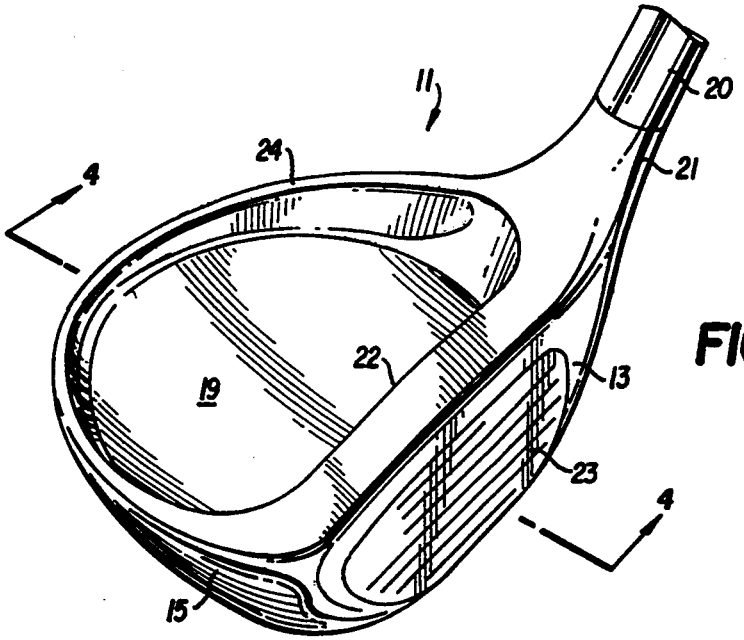
FIG. 1 is a perspective view of one embodiment of the club head of the present invention.

Club head 11 comprises a face section which includes striking face 13, toe 15, heel 17, and sole 19. A partial view of shaft 20 is shown as secured to hosel 21. Front section 24 is of a substantial thickness T (FIG. 4) and includes upper rim 22. Composition insert 23 having a thickness t is fixed in a designated cavity in the face of the club, as more clearly shown in FIG. 4. Flange 24 extends around the periphery of sole 19 and decreases in height from the ends of rim 22 down to the back edge of sole 19. As will be evident, this structure creates a crownless wood type club wherein the flange, the sole and the back of the face section collectively form an upwardly, exposed cavity in the club head.

Figure 2:
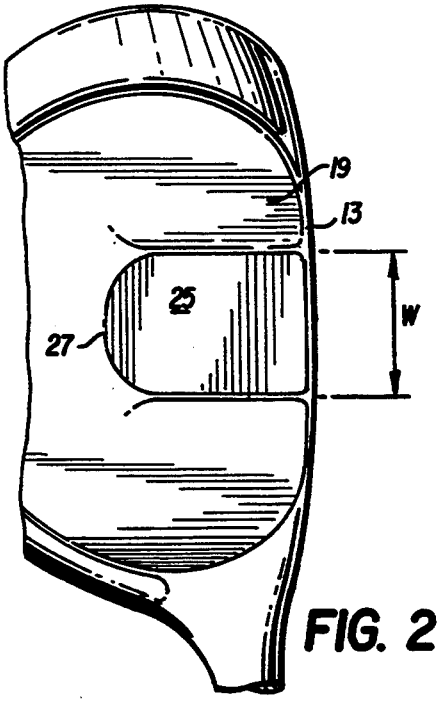
FIG. 2 is a partial bottom view of the club head of FIG. 1.

FIG. 2 is a bottom view of sole 19. This includes a flat planar surface 25 which extends from striking face 13 towards the center of the sole and terminates in arcuate edge 27. While this is a flat surface, it is smoothly integrated into the remainder part of the sole.

Figure 3:
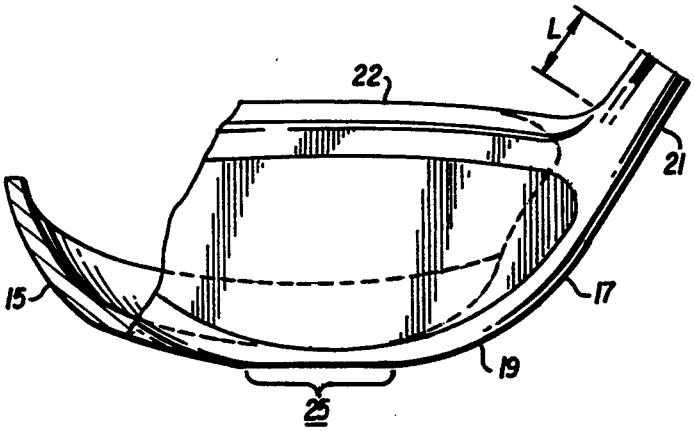
FIG. 3 is a partial cutaway front view of the club head of FIG. 1.

FIG. 3 illustrates the configuration of sole 19 with flat planar surface 25 and also indicates the general configuration of toe 15.

Figure 4:
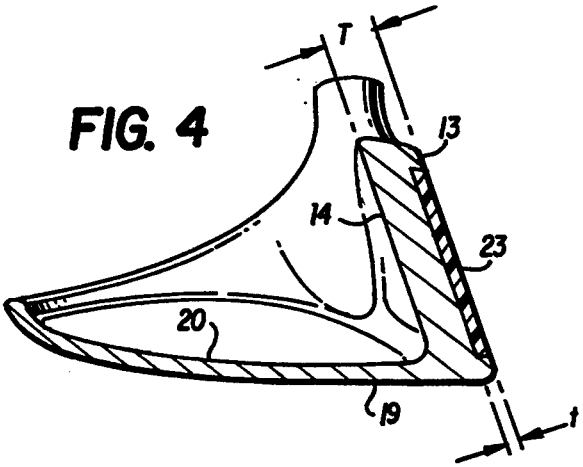
FIG. 4 is a sectional view taken through lines 4—4 of FIG. 1.

Referring to FIG. 4, striking face section 13 is of a thickness T and composition insert 23 has a thickness t.

The thickness T of striking face section 13, when made of an aluminum/graphite composition, is from 0.100 inch to 0.500 inch, and preferably from 0.150 inch to 0.400 inch, with the preferred thickness being substantially 0.375 inch. If steel is used, thickness T would be reduced.

Composition insert 23 is made of a lower density, higher strength material than the base material of the club head so as to provide low/rear weight distribution.

The thickness t of composition insert 23 is from 0.600 inch to 0.250 inch, and preferably from 0.100 inch to 0.200 inch, with the preferred thickness being 0.175 inch. Graphite may also be used for the insert material.

Use of insert composition 23 improves the striking qualities of the club and reduces vibrations which would be inherent in a club so structured with a pure metal face and face section.

While the club head illustrated includes a hosel, it is to be understood that the basic head configuration may be hoseless.

If a hosel is used in the present club as shown, it is substantially shorter than the standard hosel and preferably has a length L of substantially 0.500 inch.

The above-described club provides desirable playing characteristics in that the center of gravity of the club head is positioned low and rearwardly with a high moment of inertia. Additionally, the present club head costs less to manufacture than the standard club head since it can be molded in one piece so as to eliminate sole plate assembly and weight adjustment. Numerous patterns may be used having different sole thicknesses so as to accommodate different weight categories.

The above description and drawings are illustrative only and the invention is to be limited only by the scope of the following claims.

I/we claim:

1. A golf club head formed of a base material comprising a striking face section having a thickness T with a back of the face section being substantially parallel to a front of the face section;

a sole extending rearwardly from a bottom of said face section;

a flange extending upwardly about the periphery of said sole to the back of said striking face section, said flange decreasing in height from said back of said striking face section to a back edge of said sole; said flange, said sole and said back of said face section collectively forming an upwardly exposed cavity in said club head; and a composition insert of a thickness t in said striking face section, said insert having a lower density and higher strength than the base material of said club head.

2. The golf club head of claim 1 further comprising a hosel extending upwardly from one end of said striking face section.

3. The golf club head of claim 1 wherein said thickness T is 0.600 inch to 0.250 inch.

4. The golf club head of claim 1 wherein said thickness T is from 0.100 inch to 0.200 inch.

5. The golf club head of claim 1 wherein said thickness T is substantially 0.175 inch.

6. The golf club head of claim 1 wherein said thickness t is from 0.100 inch to 0.500 inch.

7. The golf club head of claim 1 wherein said thickness t is from 0.150 inch and 0.400 inch.

8. The golf club head of claim 1 wherein said thickness t is substantially 0.375 inch.

* * * * *